United States Patent [19]

Sato et al.

[11] 4,117,812

[45] Oct. 3, 1978

[54] AUXILIARY FUEL FEED AND TIMING CONTROL SYSTEM FOR INTERNAL COMBUSTION ENGINES

[75] Inventors: Naohiko Sato, Saitama; Keiichi Osawa, Tokyo, both of Japan

[73] Assignee: Honda Giken Kogyo Kabushiki Kaisha, Tokyo, Japan

[21] Appl. No.: 757,689

[22] Filed: Jan. 7, 1977

[30] Foreign Application Priority Data

Jan. 17, 1976 [JP] Japan ..... 51/3774

[51] Int. Cl.[2] ..... F02P 5/14; F02M 7/06

[52] U.S. Cl. ..... 123/117 A; 261/69 A

[58] Field of Search ..... 123/117 A; 261/69 A, 261/74, 65, 23 A, DIG. 74

[56] References Cited

U.S. PATENT DOCUMENTS

| | | | |
|---|---|---|---|
| 2,453,093 | 11/1948 | Jarvis | 261/69 A |
| 2,487,774 | 11/1949 | Schipper | 261/69 A |
| 2,547,579 | 4/1951 | Hunt | 261/69 A |
| 2,658,733 | 11/1953 | Boller | 261/69 A |
| 3,664,313 | 5/1972 | Walker | 261/69 R |
| 3,761,063 | 9/1973 | Shibanaka et al. | 261/69 A |
| 4,016,844 | 4/1977 | Tanaker et al. | 123/117 A |

*Primary Examiner*—Charles J. Myhre
*Assistant Examiner*—P. S. Lall
*Attorney, Agent, or Firm*—Lyon & Lyon

[57] ABSTRACT

An auxiliary fuel system for an internal combustion engine which supplements the primary fuel means for delivering fuel through a carburetor passage to said engine. The auxiliary fuel system is comprised of first and second fuel valves placed in parallel which introduce extra fuel into the intake passage of the carburetor at heavy load conditions. The first fuel valve is of the diaphragm operated type and opens and closes as a function of the pressure in a first vacuum chamber being alternatively connected to either a vacuum source at the intake passage of the carburetor or to the atmosphere. A series of electromagnetic selector valves and check valves determine the pressure conditions within said vacuum chamber. The second fuel valve is also of the diaphragm operated type, but the diaphragm is actuated by a mechanical linkage system interconnected to the throttle valve. As in the first fuel valve, movement of the dash pot diaphragm is a function of the pressure in the dash pot vacuum chamber which communicates with either the carburetor intake passage or to the atmosphere. A spark advance system is functionally interconnected to said auxiliary fuel feed control system. An electrical switching system controls the operation of both the auxiliary fuel system and the ignition timing control system so that addition of fuel during sudden non-steady state accelerations from medium speeds is delayed, and the air-fuel mixture is maintained leaner than the stoichiometric ratio. Harmful components exhausted into the atmosphere are thus minimized.

4 Claims, 2 Drawing Figures

AUXILIARY FUEL FEED AND TIMING CONTROL SYSTEM FOR INTERNAL COMBUSTION ENGINES

Figure 1A:
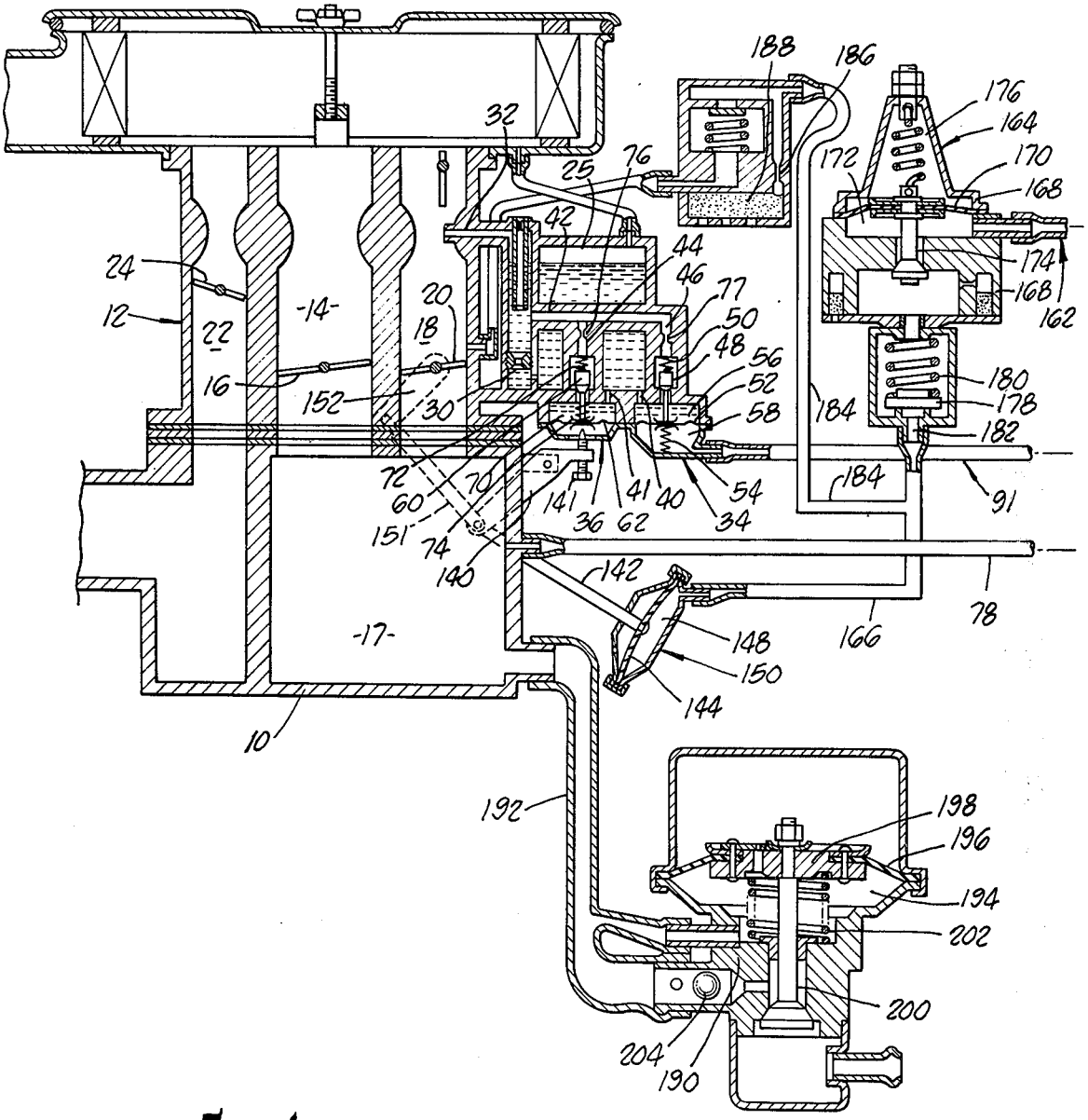

The present invention is directed to an auxiliary fuel system used to supply extra fuel to an internal combustion engine at high load conditions.

Specifically, this invention relates to an auxiliary fuel system directed to engines of the type which operate on an air-fuel mixture leaner than the stoichiometric ratio. These engines may be provided with relatively large main combustion chambers which receive a lean mixture and relatively small auxiliary combustion chambers which receive a rich mixture. After the compression stroke, ignition of the mixture in the auxiliary combustion chamber projects a flame into the main combustion chamber through a torch nozzle. A relation between the lean and rich mixtures is maintained so that the resultant overall air-fuel ratio is leaner than the theoretical or stoichiometric ratio. Generation of harmful components in the exhaust gases discharged into the atmosphere is thus kept to a minimum.

More particularly, the present invention relates to an auxiliary fuel system for this type of engine which minimizes discharge of the aforementioned harmful components into the atmosphere when sudden accelerations are accomplished at heavy load conditions from medium range speeds.

Conventional prior art systems have been equipped with auxiliary fuel mechanisms which provide additional fuel to engines operating under high loads. Understandably, these systems improve engine performance when the engine is running continuously in the steady state mode, and furthermore, since combustion of the fuel mixture is substantially complete, the quantity of harmful components exhausted into the atmosphere is kept to a minimum. This is not the case when sudden accelerations are attempted from one steady state mode to the next. Under these conditions, the sudden addition of fuel is not desirable, because harmful components exhausted into the atmosphere are increased.

Thus, the object of the present invention is to provide a system which adds additional fuel in a high load condition at steady state operation, but delays the addition of fuel in non-steady state, sudden accelerations from medium speeds so as to supply the engine with an air-fuel mixture leaner than stoichiometric throughout the range of engine operation.

In the drawings:

FIG. 1*a* is a schematic diagram, partly in section, showing a preferred embodiment of the invention including the auxiliary and main carburetor assembly.

Figure 1B:
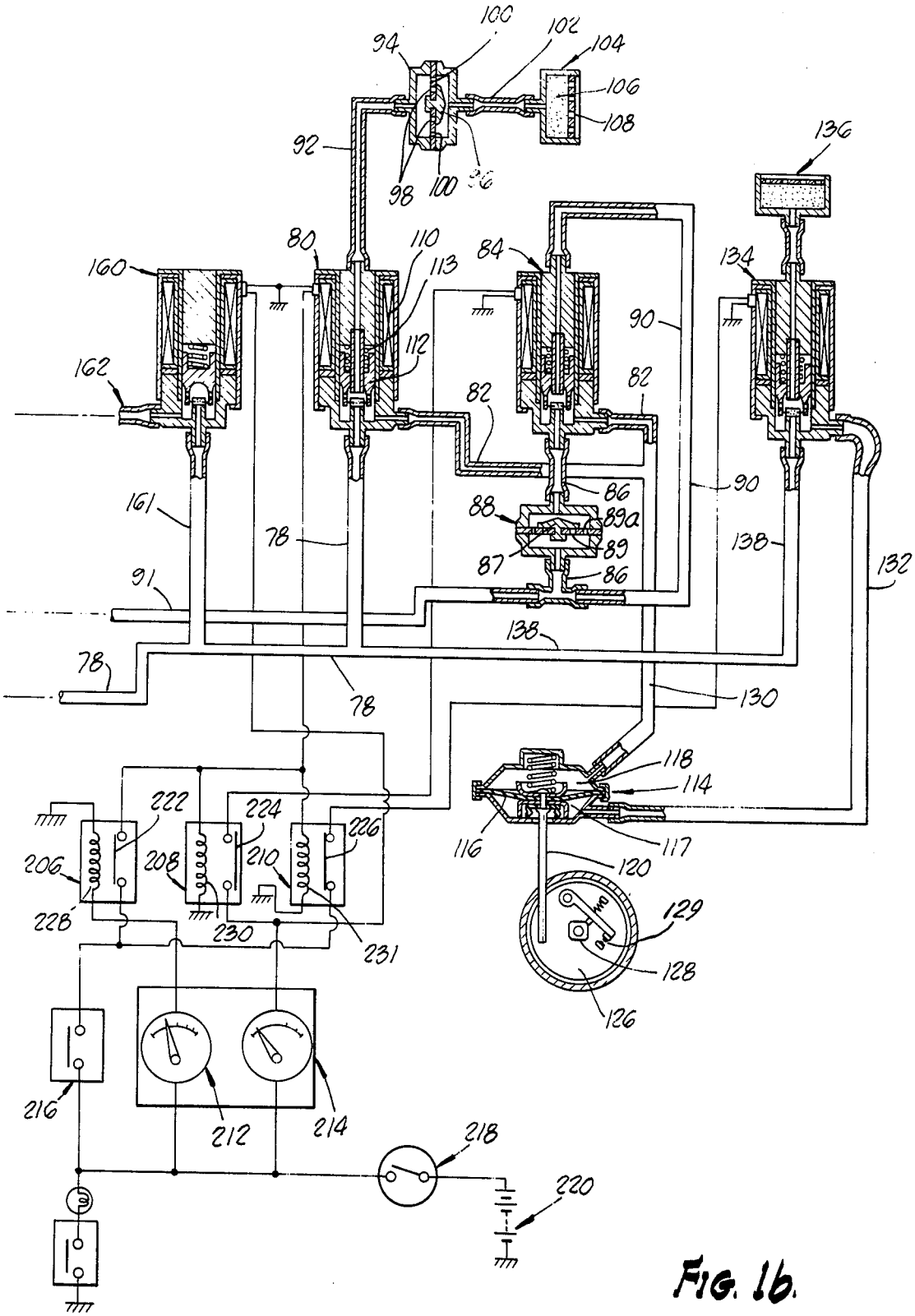

FIG. 1*b* is a continuation of the same drawing, the left-hand portion of FIG. 1*b* connected with the right-hand portion of FIG. 1*a*.

Float chamber 25 is provided for liquid fuel which is to be admitted into the main passages 18 and 14 and a separate float chamber (not shown) is provided for liquid fuel to be admitted into the auxiliary passage 22. Float chamber 25 supplies fuel to both the primary and auxiliary fuel feed systems. In the primary fuel feed system, liquid fuel from the float chamber 25 passes through the main fuel jet 30 and eventually reaches the primary main passage 18 through the main fuel nozzle 32. (The fuel systems for the secondary intake passage 14 and auxiliary intake passage 22 are substantially similar and are not shown.)

Turning to the secondary fuel system, first and second fuel valves, 34 and 36 respectively, are located beneath float chamber 25 in a parallel configuration. Both the first and second fuel valves, 34 and 36 respectively, are of the diaphragm type and are comprised of a housing within which is placed a movable wall or diaphragm. Fuel from float chamber 25 flows by means of passages 40 and 41 and is directed to first and second fuel chambers 56 and 70 bounded respectively by diaphragms 52 and 62. Movement of said diaphragms causes the stored fuel to be distributed within the primary main intake passage 18 of the carburetor through secondary fuel passage 42 while bypassing main jet 30. Fuel is transmitted from the first and second valves 34 and 36 to fuel passage 42 by means of passages 44 and 46. First and second jets 77 and 76 are interposed in said fuel passages.

The first fuel valve 34 is comprised of an operating valve 48 which is normally urged closed by spring 50. Operating valve 48 is connected to a movable wall or diaphragm 52 which is biased upwardly by spring 54. Thus, two separate chambers are defined within said first fuel valve, first fuel chamber 56, and first vacuum chamber 58. In operation, as the vacuum in said first vacuum chamber 58 decreases, diaphragm 52 moves upward, thus opening operating valve 48 and feeding additional fuel to the engine through fuel passage 42.

Second fuel valve 36, save for the vacuum chamber, is identical in structure to first fuel valve 34 and located parallel thereto. Second fuel valve 36 employs an operating valve 60 which is similar in construction to operating valve 48 previously described. As in the first fuel valve 34, a diaphragm 62 defines a second fuel chamber 70. Spring 72 urges operating valve 60 in a closed position. However, when diaphragm 62 is urged upward against spring 72, operating valve 60 is urged to an open position, and fuel from second fuel chamber 70 is caused to flow upward through channel 44, second auxiliary metering jet 76, fuel passage 42, and is eventually introduced into primary main intake passage 18. The operation and control of first and second fuel valves 34 and 36 will be described in detail. However, it is noted that their operation is such that the addition of fuel to the engine is controlled so that the air-fuel mixture is always leaner than the stoichiometric ratio so as to reduce harmful components in the exhaust gases.

Fuel valve 34 is of the vacuum control type wherein when vacuum or atmospheric pressure is introduced in first vacuum chamber 58, operating valve 48 is either urged open or closed, thus causing a surge of fuel into the primary main intake passage 18.

First fuel valve 34 is alternatively connected to vacuum source 17 or vented to the atmosphere through atmospheric vent 104. When the engine is operating at high speed, the connection is to atmosphere, and when operating at medium speed, or low speed, the connection is to the vacuum source. The primary components determining the pressure condition in first vacuum chamber 58 are first selector valve 80, second selector valve 84, and first check valve 88. Numerous vacuum and air passages serve to connect this check valve and selector valve system so as to selectively route intake vacuum pressure 17 or atmospheric pressure to first vacuum chamber 58. At this junction, the operation of selector valves 80 and 84 is important. As valves 80 and 84 are duplicates, a description of valve 80 will suffice.

Valve 80 is of an electromagnetic type which is selectively actuated by operating solenoid coil 110. The moving armature 112 of this solenoid acts against return spring 113 when energized. Energy is supplied by power source 220 through a switching system which will be explained in detail later. Thus, upon actuation of one or more of the switches in the switching system, the solenoid in selector valve 80 is energized, pulling the movable armature 112 against the spring 113.

Construction of identical check valves 88 and 94 is described as follows: The movable valve element 96, in valve 94 for example, closes the ports 98 against the flow in one direction while the porous inserts 100 allow slow flow in either direction. Thus, in the low velocity mode where first electromagnetic selector valve 80 is energized and valve 84 is closed, it is noted that vacuum from intake vacuum source 17 is transmitted through first vacuum passage 78 to first electromagnetic selector valve 80. Since valve 80 is energized, armature 112 is drawn against spring 113, thus closing off air passage 92, but allowing first vacuum passage 78 to communicate with second vacuum passage 82. Since valve 84 is not energized, vacuum pressure is allowed to be transmitted from passage 82 to fourth vacuum passage 90. Vacuum intensity is thus allowed to act on first vacuum chamber 58, thus holding operating valve 48 in a closed position.

At the medium velocity steady state mode, both electromagnetic valves 80 and 84 are energized. This allows transmittal of vacuum intensity from intake vacuum source 17 through first vacuum passage 78 through first selector valve 80 to second vacuum passage 82, through second selector valve 84 and, to first check valve 88. It is noted that since electromagnetic valve 84 is energized, passage to fourth vacuum passage 90 is blocked whereas third vacuum passage 86 and second vacuum passage 82 are allowed to communicate. From first check valve 88 which is interposed in third vacuum passage 86, vacuum intensity is allowed to be transmitted through vacuum passage 91 to first vacuum chamber 58. Unlike in the low velocity mode, operation in the medium velocity mode allows vacuum to be transmitted through first check valve 88 which is placed between vacuum source 17 and first vacuum chamber 58. This check valve opens only when the vacuum at the vacuum source 17 is greater than the vacuum intensity in the first vacuum chamber 58 as will be further explained. If the vacuum intensity at intake vacuum source 17 drops suddenly, the vacuum intensity in first vacuum chamber 58 causes the movable valve element 87 to close the ports within said valve, thus forcing the vacuum intensity to drain through the porous inserts 89*a* in a delayed fashion. This is in marked contrast with the low velocity mode wherein first check valve 88 is bypassed by means of fourth vacuum passage 90.

In the high velocity mode, both first and second selector valves are not energized. This causes first vacuum passage 78 to be blocked off while vacuum passage 82 is vented to the atmosphere. First vacuum chamber 58 is vented to the atmosphere as follows: atmospheric air enters ports 108 in atmospheric vent 104, passes through filter 106, through air passage 102, second check valve 94, air passage 92, and first selector valve 80. Since selector valve 80 is unenergized, air passage 92 is allowed to communicate with second vacuum passage 82 which communicates with fourth vacuum passage 90 through valve 84 which communicates with first vacuum chamber 58 through vacuum passage 91. Second check valve 94 is of the same type as first check valve 88 allowing for a venting of vacuum intensity in chamber 58 to the atmosphere in a delayed manner in the high velocity mode.

An ignition timing control system is operatively connected to said previously described first fuel valve system. In this regard, ignition timing vacuum actuator 114 is provided which comprises a main housing surrounding a movable wall or diaphragm 116 to create advance vacuum chamber 117 and retard vacuum chamber 118. Movably positioned through the actuator 114 is a control rod 120 conventionally associated with diaphragm 116. The diaphragm is fixed to the control rod 120 so that pressure differentials on the diaphragm will result in the advancing or retarding of the ignition timing. Actuator rod 120 is connected by its projecting end to a point base 126 of conventional design. The contact breaker cam 128, contact point 129 and point base 126 are conventional also. Both vacuum chambers 117 and 118 may be alternatively connected to a vacuum source 17 at the intake passage of the engine or to the atmosphere as follows: advance vacuum chamber 117 is allowed to communicate with intake vacuum source 17 by means of vacuum passage 132, third actuator valve 134, and vacuum passage 138 which communicates with first vacuum passage 78 in turn communicating with the intake vacuum source 17. This communication occurs only when actuator valve 134 is in an energized position. Third actuator valve 134 is similar in structure and operation to first and second electromagnetic actuator valves 80 and 84. When selector valve 134 is not energized, vacuum passage 138 is blocked off, thus venting advance vacuum chamber 117 to the atmosphere by means of atmospheric vent 136, which is similar in structure to atmospheric vent 104.

Retard vacuum chamber 118 can communicate with intake vacuum source 17 by means of vacuum passages 130, 82 and 78. Of course, this is dependent on whether first electromagnetic selector valve 80 is energized or not. When electromagnetic valve 80 is not energized, first vacuum passage 78 is blocked off and retard vacuum chamber 118 is vented to the atmosphere by means of atmospheric vent 104, air passage 102, check valve 94, air passage 92, selector valve 80, second vacuum passage 82, and vacuum passage 130.

In operation, during the low velocity mode, third electromagnetic selector switch 134 is not energized, thus blocking off vacuum passage 138 and venting advance vacuum chamber 117 to the atmosphere by means of atmospheric vent 136. On the other hand, the first electromagnetic selector switch 80 is energized while the second electromagnetic selector switch 84 is not. This allows retard vacuum chamber 118 to be connected to intake vacuum source 17 by means of vacuum passage 130, second vacuum passage 82, and first passage 78. The pressure imbalance on diaphragm 116 causes control rod 120 to move the point base 126 in a clockwise direction, thus causing retarding of the spark setting.

Operation of the system in the medium velocity mode is similar to the low velocity mode.

In the high velocity mode, selector switch 134 is energized, allowing communication between vacuum passage 132 and vacuum passage 138 causing advance vacuum chamber 117 to communicate with intake vacuum source 17. At the same time, since first and second electromagnetic selector valves 80 and 84 are not energized, atmospheric air is allowed to flow to retard vacuum chamber 118. The resulting imbalance on diaphragm 116 causes control rod 120 to turn point base 126 in a counterclockwise direction and thus advancing the spark timing.

In the operation of the second fuel valve system, when diaphragm 62 is urged upward, fuel flows through second auxiliary metering orifice 76, fuel passage 42, and main fuel nozzle 32 to the main intake passage 18 of the carburetor.

Diaphragm 62 is urged upward by means of the action of lever 140 and adjusting screw 141. Lever 140 is in turn activated by linkage arm 151 and throttle lever 152, which is connected to primary main intake passage throttle 20. Linkage arm 151 is also operatively connected to actuating rod 142, which is connected to diaphragm 144 in dash pot 150 serving also as a throttle opener. Thus, when throttle valve 20 is widely opened, previously mentioned diaphragm 62 is forced upward causing an addition of fuel to the engine.

Dash pot vacuum chamber 148 is alternatively vented to the atmosphere or to intake vacuum source 17 as follows: when fourth electromagnetic selector valve 160 is energized, which occurs only in the medium velocity mode, vacuum is transmitted from intake vacuum source 17 to first vacuum passage 78 to vacuum passage 161 through fourth selector valve 160 to vacuum passage 162, through valve assembly 164, through vacuum passage 166 and to dash pot vacuum chamber 148. Save for the absence for an atmospheric vent, fourth electromagnetic selector valve 160 is similar in operation and structure to selector valves 80, 84 and 134.

Valve assembly 164 is comprised primarily of diaphgram 170 to which is connected valve member 174, which is urged toward a closed position by spring 176. Thus, when the vacuum intensity in vacuum chamber 172 approaches a certain predetermined value, valve member 174 is urged against spring 176 thus effectuating opening of said valve. Additionally, a check valve element 178 is provided which is urged by spring 180 against opening 182 so that if the vacuum intensity exceeds a predetermined amount, valve member 178 is urged away from opening 182 causing vacuum to be transmitted to the dash pot 150. Thus, the function of valve assembly 164 is to allow transmission of a vacuum intensity of only a predetermined range. Alternatively, dash pot 150 can be vented to the atmosphere by virtue of vacuum passage 166, air passage 184, flow orifice 186 and filter 188.

Air valve 190 is included to introduce air into intake vacuum 17 under certain conditions. In operation, vacuum is introduced into vacuum chamber 194 of air valve 190 from intake vacuum source 17 through passage 192. Vacuum chamber 194 is defined by the housing of valve 190 and diaphragm 196. Plate 198 is attached to diaphragm 196 and connected to valve member 200 which is urged in a closed position by spring 202. If the vacuum intensity in vacuum source 17 is great enough, the compression of spring 202 is overcome, thus urging valve 200 in an open position and allowing air to be introduced in intake vacuum source 17. Ball valve 204 is included to prevent air flowing through air valve 190 from an intake manifold 10, to atmosphere.

Valves 80, 84, 134 and 160 are controlled by an electrical circuit comprised of first, second and third relays 206, 208 and 210, high speed switch 212, medium speed switch 214, oil temperature switch 216, and ignition switch 218. Power source 220 is connected to said electrical system by ignition switch 218. Additionally, oil temperature switch 216 closes only when the temperature of the oil in the engine is high, (for example, 65° C. or higher).

The other elements of the electrical control system are high speed switch 212 which closes at high speed running, (for example at 45 kilometers per hour or higher) and medium speed switch 214 which closes at medium speed running, (for example, at 10 to 45 kilometers per hour). First, second and third relays employ switch 222, normally in a closed position, switch 224, normally in an open position, and switch 226, normally in a closed position.

In operation, when the ignition switch 218 is turned on, the oil temperature switch 216 is closed and the vehicle velocity mode is low, electricity flows through switch 222 to energize the coil of first electromagnetic selector valve 80. At the same time, electricity flows through coil 231, opening switch 226 which is normally closed, thus cutting off electricity to the third selector valve 134.

When the vehicle speed approaches the medium range, medium speed switch 214 closes allowing electricity to flow through switch 224 in the second relay 208 which has been urged in a closed position by virtue of energized coil 230. Electricity flows to the first, second and fourth electromagnetic selector valves 80, 84 and 160. As in the low velocity mode, electromagnetic selector valve 134 is not energized, by virtue of the opening of switch 226.

At the high velocity mode, high speed switch 212 is closed, thus energizing coil 228 and opening switch 222 in the first relay. This prevents electricity from energizing coil 231 and thus allows switch 226 in the third relay to remain closed. This energizes the third electromagnetic selector valve 134, thus causing an advance of the spark timing.

In summation, in the low velocity steady state mode, the first selector valve 80 only is energized, causing the first and second fuel feed valves 34 and 36 to be urged in a closed position and causing the timing to be retarded. When the throttle is suddenly urged open, to cause acceleration the vacuum intensity in intake vacuum passage 17 immediately decreases, and since check valve 88 is bypassed, this signal is immediately relayed to first fuel valve 34 urging it to open and allowing extra fuel to be added to the engine. Since fourth selector valve 160 is not energized, no vacuum is introduced to dash pot chamber 148, and dash pot 150 does not serve as a throttle opener. Additionally, in the low velocity acceleration mode, a decrease in vacuum is immediately communicated to retard vacuum chamber 118, causing timing to be advanced.

In the medium velocity mode, selector valves 80, 84, and 160 are all energized and operative while valve 134 is not energized. This causes first fuel valve 34 to be urged closed, dash pot chamber 148 to be connected to vacuum source 17 to actuate dash pot 150 as a throttle opener and the timing is retarded. In the medium velocity acceleration mode, when the throttle valve 20 is suddenly opened to cause acceleration, the vacuum at intake vacuum source 17 decreases. However, this decrease in vacuum in delayed by virtue of check valve 88, within which ports 89 are closed by virtue of pressure on the movable valve element 87. Thus, the draining of the vacuum intensity in the first vacuum chamber 58 is delayed, causing the first fuel valve 34 to open, but in a delayed fashion. Thus, instantaneous surges of fuel of the engine are avoided corresponding to any sudden depressions of the accelerator. As in the low velocity mode, timing is correspondingly retarded.

When the system enters the high velocity mode, selector valves 80, 84 and 160 are not energized, while selector valve 134 is energized. The result of this is that atmospheric air is introduced to said first vacuum chamber 58 urging the first fuel valve 34 to open; albeit in a delayed fashion because of second check valve 94. Since there is no vacuum in dash pot chamber 148, dash pot 150 does not serve as a throttle opener. Additionally, in the high velocity mode, the energization of selector valve 134 causes the timing to be advanced.

Upon acceleration from the high velocity steady state mode, there is no substantial change in operating conditions save for the fact that the vacuum intensity in advance vacuum chamber 117 in the ignition timing vacuum actuator 114 is decreased, thus causing the spark timing to be somewhat retarded.

In summation, the foregoing system causes a delay in the introduction of fuel to the engine when the engine is caused to suddenly accelerate from steady state medium speed conditions, thus maintaining the mixture introduced into the engine leaner than the stoichiometric air-fuel ratio, while at the same time regulating the spark advance in such a way that harmful components exhausted into the atmosphere are reduced.

Having fully described our invention, it is understood that we are not to be limited to the details herein set forth, but that our invention is of the full scope of the appended claims.

We claim:

1. For use with an internal combustion engine having fuel supplied thereto by a carburetor assembly having at least one intake passage and a throttle valve positioned within said passage, said carburetor assembly including a first fuel feed means to deliver fuel to said passage, a second fuel feed system comprising, in combination: a fuel valve of the diaphram type including a vacuum chamber formed on one side of a flexible diaphragm and a fuel chamber on the other side of said diaphragm, the passage connecting said fuel chamber to the intake passage, a speed detector, selector valve and check valve means whereby said vacuum chamber is connected to said engine intake passage downstream from said throttle valve at low speeds, connected to said passage through a check valve at medium speeds and vented to the atmosphere when high speeds are attained.

2. The system described in claim 1 wherein ignition timing means are provided to advance the spark setting at high speed conditions, and to retard the spark setting at low and medium speed conditions.

3. For use with an internal combustion engine having a throttle valve positioned in an intake passage, and having a first fuel supply system for delivering fuel to said intake passage to produce an air-fuel mixture leaner than the stoichiometric ratio, the improvement comprising, in combination: a second fuel supply system for delivering additional fuel to the intake passage, a high load detector to detect high load operation of said engine, means responsive to action of the high load detector to cause delivery of additional fuel through said second fuel supply system, said means acting to delay delivery of additional fuel upon opening movement of said throttle valve to cause acceleration, and thereby reduce harmful components in the exhaust gases of the engine, and means for inhibiting delivery of additional fuel from said second fuel supply system when the engine is below a predetermined temperature.

4. For use with an internal combustion engine to drive a vehicle having a throttle valve positioned in an intake passage, and having a first fuel supply system for delivering fuel to said intake passage to produce an air-fuel mixture leaner than the stoichiometric ratio, the improvement comprising, in combination: a second fuel supply system for delivering additional fuel to the intake passage, a high load detector to detect high load operation of said engine, means responsive to action of the high load detector to cause delivery of additional fuel through said second fuel supply system, said means acting to delay delivery of additional fuel upon opening movement of said throttle valve to cause acceleration, and thereby reduce harmful components in the exhaust gases of the engine, and means for permitting delivery of additional fuel from said second fuel supply system only when the engine drives the vehicle at above a predetermined speed.

* * * * *

UNITED STATES PATENT AND TRADEMARK OFFICE

CERTIFICATE OF CORRECTION

PATENT NO. : 4,117,812

DATED : October 3, 1978

INVENTOR(S) : Naohiko Sato et al

It is certified that error appears in the above–identified patent and that said Letters Patent are hereby corrected as shown below:

Column 5, line 28, after "absence", the word "for" should read --of--.

Column 6, line 63, after "vacuum", the word "in" should read --is--.

Column 7, line 1, the word "of" should read --to--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*